United States Patent [19]

Gardner et al.

[11] 4,376,508

[45] Mar. 15, 1983

[54] CONTAINER WITH INTEGRAL PARTITION

[75] Inventors: Jeffrey M. Gardner, Wheaton; Nicholas A. Philips, Glendale Hts., both of Ill.

[73] Assignee: Container Corporation of America, Chicago, Ill.

[21] Appl. No.: 291,289

[22] Filed: Aug. 10, 1981

[51] Int. Cl.[3] ..... B65D 5/48

[52] U.S. Cl. ..... 229/28 R; 229/15

[58] Field of Search ..... 229/27, 28 R, 15, 16

[56] References Cited

U.S. PATENT DOCUMENTS

| | | | |
|---|---|---|---|
| 3,825,174 | 7/1974 | Booth | 229/28 R |
| 4,172,550 | 10/1979 | Garmon | 229/28 R |
| 4,192,444 | 3/1980 | Garmon | 229/28 R |

*Primary Examiner*—Herbert F. Ross

*Attorney, Agent, or Firm*—Richard W. Carpenter; Davis Chin

[57] ABSTRACT

A shipping container formed, from a unitary blank of paperboard, which includes an integral partition member.

2 Claims, 4 Drawing Figures

CONTAINER WITH INTEGRAL PARTITION

BACKGROUND OF THE INVENTION

1. Field of the Invention:

This invention relates to paperboard shipping containers, and more particularly to a shipping container having an integral partition member.

2. Description of the Prior Art:

A prior art search directed to the subject matter of this application in the United States Patent and Trademark Office revealed the following prior art U.S. Pat. Nos. 1,740,550; 1,962,920; 2,023,578; 2,078,906; 2,648,481; 2,648,483; 2,697,544; 2,888,185; 3,115,290; 3,145,903; 3,157,344; 3,825,174, 3,977,592; 4,185,766; 1,943,074, 2,364,829; 2,454,029; 2,502,384; 2,663,491; 2,965,277; 3,107,041; 3,133,633; 3,318,507; 3,556,385; 4,143,768.

None of the prior art patents uncovered in the search disclosed a shipping container formed from a one-piece blank of paperboard which includes an integral partition member containing a plurality of partition elements certain of which are joined to closure flaps by webs formed from material cut from the closure flaps.

SUMMARY OF THE INVENTION

This invention relates to shipping containers, and more particularly to shipping containers of the type having internal partitions which, together with the side walls of the container, divide the interior of the container into separate cells or compartments.

It is common in the art to provide separate partition members for shipping containers. It is also not uncommon to have partition members formed integrally with the other portions of the container. Generally partition members of this type are joined to the side walls of the container along fold lines parallel to those fold lines which join the other side walls of the container to each other.

It is an object of this invention however to provide a unique type of integral partition arrangement, wherein certain sections of the partition member are attached to the blank by means of web elements cut from and foldably joined to certain of the closure flaps.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
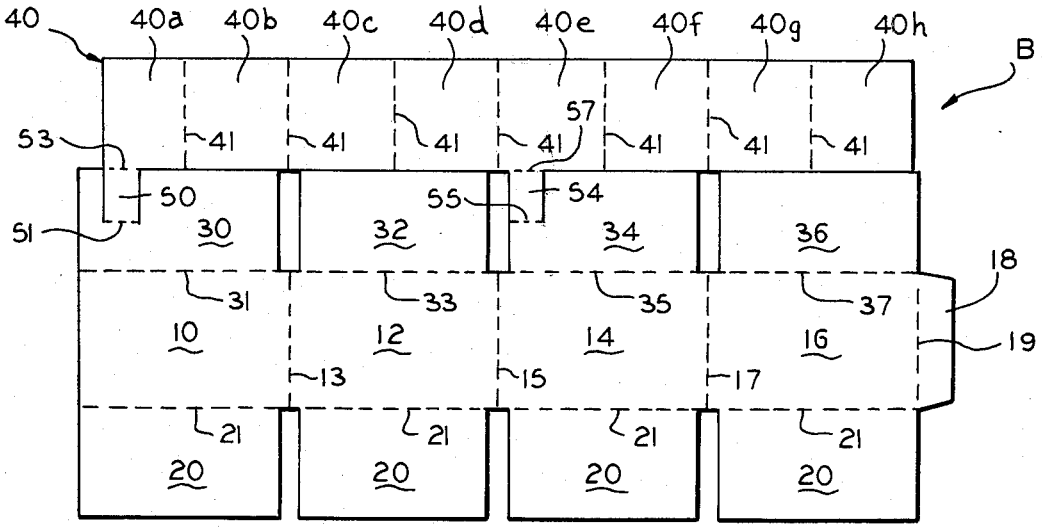
FIG. 1 is a plan view of a blank of foldable sheet material from which the container embodying features of the invention and illustrated in the other views may be formed.
Figure 2:
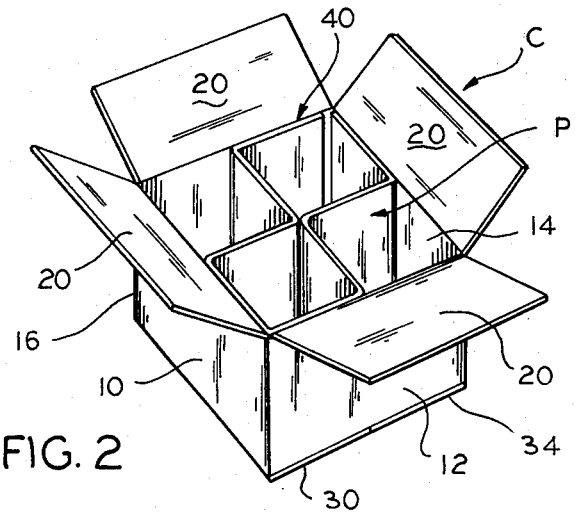
FIG. 2 is a perspective view of a container having the novel partition arrangement embodying features of the invention.

Referring now to the drawings for a better understanding of the invention, and particularly to FIGS. 1 and 2, it will be seen that the novel container indicated generally at C in FIG. 2 may be formed from the unitary blank B of foldable sheet material, such as paperboard, illustrated in FIG. 1.

As best seen in FIGS. 1 and 2, the central portion or body of container C includes first, second, third and fourth side wall panels 10, 12, 14 and 16, respectively, and a glue flap 18, which are foldably joined to each other on fold lines 13, 15, 17 and 19, respectively, to form a tubular structure open at the ends.

In examining the drawings it should be understood that blank B illustrated in FIG. 1 is shown in an inverted position with respect to the structure of the other views.

The closure means for the upper end of the container includes opposed pairs of upper closure flaps 20 which are foldably joined on fold lines 21 to the upper edges of the respective side walls.

Likewise, the closure means for the bottom end of the container includes first, second, third and fourth lower closure flaps 30, 32, 34 and 36 which are foldably joined to the lower edges of the side wall panels 10, 12, 14 and 16 on fold lines 31, 33, 35 and 37, respectively. It is to be noted that first and third lower closure flaps 30 and 34 are inner closure flaps; whereas, second and fourth lower closure flaps 32 and 36 are outer closure flaps. In order to divide the interior of the container into separate compartments or cells there is provided a partition member indicated generally at 40 in which formed integrally with the other portions of blank B and which includes a plurality of serially arranged partition sections **40*a*, 40*b* 40*c*, 40*d*, 40*e*, 40*f*, 40*g*, and 40*h* which are joined to each other along parallel fold lines 41**.

The integral partition member 40 is connected to the remained of the blank by a pair of web elements indicated at 50 and 54 which are cut from material of lower closure flaps 30 and 34, respectively and which are hingedly attached to the lower closure flaps 30 and 34 on fold lines 51 and 55 and which are foldably joined to partition member sections **40*a* and 40*e* on fold lines 53 and 57**, respectively.

Figure 3:
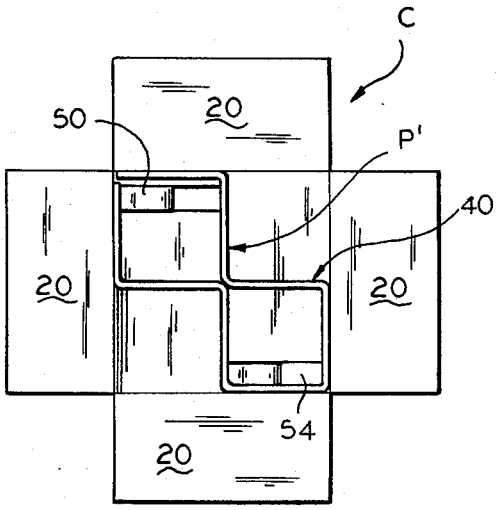
FIG. 3 is a plan of the structure illustrated in FIG. 2.
Figure 4:
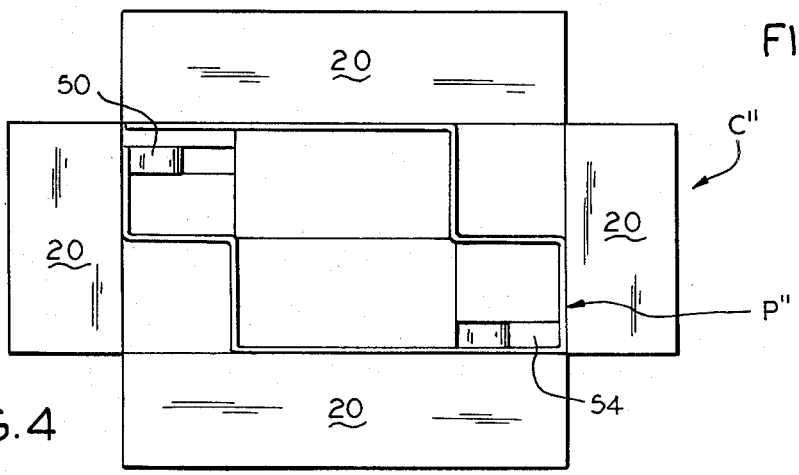
FIG. 4 is a view similar to FIG. 3 but illustrating a slightly modified form of the invention.

Thus, in order to form the structure illustrated in FIGS. 2–4 from the blank B illustrated in FIG. 1, the partition member is first folded over 180° so that it overlies the body of the container with sections **40*a* and 40*b* overlying side wall panel 10 and the other sections of the partition overlying their related side wall panels in the same manner. After this has been done the blank may be formed into a tubular structure with glue flap 18 secured to side wall panel 10** in a conventional manner.

At this point when the lower closure flaps are folded into position and secured to each other in any conventional manner, such as by stapling, gluing or taping, the various partition elements **40*a* through 40*h* will be located in the central portion of the container and may be arranged in any desired manner, such as shown in FIG. 2 and FIG. 3**.

Referring now to FIG. 4 it will be seen that a slightly modified form of the invention is shown. In this case the arrangement is basically the same as that of the previously described embodiment except for the overall dimensions. In the embodiment of FIGS. 2 and 3 a generally square container is used; whereas, in FIG. 4 an elongated rectangular container is used. The basic principles are the same and therefore the blank for the container C″ which has an integral partition P″ is not shown in detail.

It will be appreciated that this invention offers a novel way to provide an integral container partition arrangement of simple design and construction which is easy to erect, either manually or on a machine.

What is claimed is:

1. A container formed from a unitary blank of foldable paperboard and including an integral partition member for dividing the interior of the container into separate cells, said container comprising:

(a) first, second, third and fourth side wall panels foldably interconnected to form a tubular structure open at the ends;

(b) opposed pairs of upper closure flaps foldably joined to upper edges of said side wall panels for closing the top end of said tubular structure;

(c) first, second, third and fourth lower closure flaps foldably joined to lower edges of said first, second, third and fourth side wall panels respectively;

(d) a partition member consisting of eight serially arranged partition elements foldably joined to each other on parallel fold lines, said partition member being positioned within said tubular structure to provide separate cells; and (e) connecting webs hingedly joining said first and third lower closure flaps to the first and fifth partition elements of said partition member, each connecting web extending within the periphery of its respective closure flap and hingedly connected thereto, each said web further having a parallel hinge connection connected to the adjacent edge of the respective partition elements.

2. A unitary blank of foldable sheet material, such as paperboard, which is cut and scored to form a shipping container having an integral partition member, said blank comprising:

(a) first, second, third and fourth side wall panels foldably joined to each other at their side edges on parallel fold lines;

(b) opposed pairs of upper closure flaps foldably joined to upper end edges of said side wall panels;

(c) first, second, third and fourth lower closure flaps foldably joined to lower end edges of said first, second, third and fourth side wall panels respectively.

(d) a partition member including eight serially arranged partition elements foldably joined to each other on parallel fold lines; and (e) connecting web elements foldably joining said first and third lower closure flaps to the first and fifth partition elements of said partition member, each connecting web element extending within the perphery of its respective closure flap and hingedly connected thereto, each said web element further having a parallel hinge connection connected to the adjacent edge of the respective partition elements.

* * * * *